United States Patent [19]

Fujimoto et al.

[11] Patent Number: 4,601,957

[45] Date of Patent: Jul. 22, 1986

[54] METHOD FOR PRODUCING A THIN TIN AND NICKEL PLATED STEEL SHEET FOR WELDED CAN MATERIAL

[75] Inventors: Terunori Fujimoto, Kudamatsu; Yasuhiko Nakagawa, Yamaguchi; Toshio Baba, Hikari; Hirokazu Moriyama, Kudamatsu; Akio Miyachi, Hikari; Tsuneo Inui, Tokuyama, all of Japan

[73] Assignee: Toyo Kohan Co., Ltd., Tokyo, Japan

[21] Appl. No.: 770,777

[22] Filed: Aug. 29, 1985

[51] Int. Cl.[4] ..... C25D 5/36; C25D 5/50

[52] U.S. Cl. ..... 428/622; 204/27; 204/28; 204/34; 204/37.3; 204/40; 204/41; 204/42; 428/621; 428/629; 428/632; 428/648

[58] Field of Search ..... 204/34, 37.3, 40, 41, 204/42, 27, 28; 428/648, 632, 629, 622, 621

[56] References Cited

U.S. PATENT DOCUMENTS

| | | | |
|---|---|---|---|
| 2,513,859 | 7/1950 | Glock | 204/28 |
| 3,075,897 | 1/1963 | Higgs | 204/42 |
| 3,620,934 | 11/1971 | Endle | 204/34 |
| 3,982,314 | 9/1976 | Ariga et al. | 29/527.4 |
| 4,104,135 | 8/1978 | Fujimaki et al. | 204/40 X |
| 4,468,292 | 8/1984 | Ban et al. | 204/27 |
| 4,501,802 | 2/1985 | Higuchi et al. | 428/629 |
| 4,513,995 | 4/1985 | Niehaus et al. | 285/55 |

*Primary Examiner*—G. L. Kaplan

*Attorney, Agent, or Firm*—Wenderoth, Lind & Ponack

[57] ABSTRACT

A method for producing a thin tin and nickel plated steel sheet having a surface structure in which the distribution of numerous nodules of metallic tin are observed by using an electron microscope on an iron-tin-nickel alloy layer formed on a steel sheet which comprises electroplating nickel on the steel sheet which is anodically treated in an alkaline electrolyte with a pH of above 10 followed by electrotinplating the nickel plated steel sheet, reflowing, quenching, and then chromate treating the tin and nickel plated steel sheet.

This tin and nickel plated steel sheet is suitable for welded can materials since it is excellent in corrosion resistance after lacquering and weldability.

16 Claims, 4 Drawing Figures

METHOD FOR PRODUCING A THIN TIN AND NICKEL PLATED STEEL SHEET FOR WELDED CAN MATERIAL

FIELD OF THE INVENTION

The present invention relates to a method for producing a thin tin and nickel plated steel sheet having excellent corrosion resistance after lacquering and excellent weldability. In detail, the invention relates to a method for producing a thin tin and nickel plated steel sheet which is characterized by an anodic treatment of a pickled steel sheet in an alkaline electrolyte with a pH of above 10 before plating with a small amount of nickel, plating with a small amount of tin on the nickel plated steel sheet, reflowing, quenching, and chromate treating the tin and nickel plated steel sheet.

By using this tin and nickel plated steel sheet, a welded can body can be easily produced at high speed in spite of the small amount of the plated tin and nickel without removing the plated layer in the welded part.

BACKGROUND AND OBJECTIVE

Recently, electric welding has been widely used for the seaming of tinplate can bodies in the field of food cans, aerosol cans, and miscellaneous cans, instead of soldering. In the seaming of the tinplate can body, it is desirable to decrease the tin coating weight in the tinplate because tin used for electrotinplate is very expensive and there is concern over the exhaustion of tin resources. However, the weldability of the tinplate becomes gradually poor with a decrease of the tin coating weight.

From the background described above, the development of a welded can material which is cheaper than conventional electrotinplate, is easily welded at high speed without the removal of the plated layer and is excellent in corrosion resistance after lacquering, has been required in the field of food cans. Over the past few years, various surface treated steel sheets have been proposed for welded can materials which can be easily welded at high speed without the removal of the plated layer and is cheaper than tinplate. For instance, the following surface treated steel sheets have been proposed: (a) Lightly tin plated steel sheet (LTS) with below about 1.0 g/m$^2$ of tin which is reflowed or unreflowed after tinplating (Japanese Patent Publication Nos. Sho 56-3440, Sho 56-54070, Sho 57-55800, and Laid-Open Japanese Patent Application Nos. Sho 56-75589, Sho 56-130487, Sho 56-156788, Sho 57-101694, Sho 57-185997, Sho 57-192294, Sho 57-192295, and Sho 55-69297). (b) Nickel preplated LTS with below about 1.0 g/m$^2$ of tin (Laid-Open Japanese Patent Application Nos. Sho 57-23091, Sho 57-67196, Sho 57-110685, Sho 57-177991, Sho 57-200592, Sho 57-203797, Sho 60-33362, and Sho 60-56074). (c) Nickel plated steel sheet with chromate film or phosphate film (Laid-Open Japanese Patent Application Nos. 56-116885, Sho 56-169788, Sho 57-2892, Sho 57-2895, Sho 57-2896, Sho 57-2897, Sho 57-35697, Sho 57-35698).

However, LTS and nickel preplated LTS above identified as (a) and (b) have a narrower current range for sound welding than that in tinplate, although these can be welded without the removal of the plated layer. The reason why the current range for sound welding in LTS and nickel preplated LTS is narrower than in tinplate is considered to be that the amount of free metallic tin in these is smaller than that in tinplate and also further decreases because of the change of plated free metallic tin to iron-tin alloy or iron-tin-nickel alloy by heating for lacquer curing or reflowing after tinplating.

An increase of the tin coating weight in LTS and nickel plated LTS is contrary to the development of cheaper welded can material than tinplate, although the weldability and the corrosion resistance after lacquering are improved with an increase of it. An increase in the amount of nickel in nickel preplated LTS improves the corrosion resistance after lacquering, but does not improve the weldability, because the amount of free metallic tin decreases by the formation of tin-nickel alloy during aging at room temperature or by the formation of iron tin-nickel alloy during reflowing nickel preplated LTS.

Nickel plated steel sheet with chromate film or phosphate film identified above as (c) also has a narrower current range for sound welding than that in tinplate, LTS, or nickel preplated LTS.

Furthermore, the corrosion resistance of nickel plated steel sheet is poor, although the lacquer adhesion is good. Particularly, pitting corrosion in the defective part of the lacquered nickel plate steel sheet may occur easily in acidic foods such as tomato juice because the electric potential of nickel is more noble than that of steel sheet.

As described above, the various surface treated steel sheets proposed in (a), (b), and (c) have various problems in production cost and characteristics as a welded can material which can be easily welded without the removal of the plated layer at high speed.

Accordingly, it is the first objective of the present invention to provide a thin tin and nickel plated steel sheet having excellent corrosion resistance after lacquering and excellent weldability.

It is the second objective of the present invention to provide a method for the continuous production of a thin tin and nickel plated steel sheet having excellent characteristics as described above.

BRIEF DESCRIPTION OF THE INVENTION

The first objective of the present invention can be accomplished by providing a thin tin and nickel plated steel sheet having a surface structure in which the distribution of numerous nodules of metallic tin is observed by using an electron microscope on the iron-tin-nickel alloy layer formed on the steel sheet as shown in FIG. 1.

The second objective of the present invention can be accomplished by an electroplating with a small amount of nickel on the steel sheet which is anodically treated in an alkaline electrolyte with a pH of above 10 followed by an electroplating with a small amount of tin on the nickel plated steel sheet, reflowing, quenching, and then chromate treating the tin and nickel plated steel sheet.

The tin and nickel plated steel sheet according to the method of the present invention is clearly different from the nickel preplated LTS, which has already been disclosed in various Laid-Open Japanese Patent Applications, in the surface structure, particularly in the form of metallic tin on the iron-tin-nickel alloy layer formed on the steel sheet, although it nevertheless is a nickel preplated LTS. Namely, in the tin and nickel plated steel sheet according to the present invention, numerous nodules of metallic tin are present on the iron-tin-nickel alloy layer formed on the steel sheet. On the other hand, it is considered that a uniform and thin metallic tin layer is formed on the iron-tin-nickel alloy layer or the tin-nickel alloy layer formed on the steel sheet in the known nickel preplated LTS.

DETAILED DESCRIPTION OF THE INVENTION

The steel sheet used for the production of the tin and nickel plated steel sheet according to the present invention can be any cold rolled steel sheet customarily used in manufacturing electro-tin plated and tin-free steel. Preferably the thickness of the steel sheet is from about 0.1 to about 0.35 mm.

The tin and nickel plated steel sheet according to the present invention is produced by the following process: degreasing with an alkali and pickling with an acit→water rinsing→an anodic treatment in an alkaline electrolyte→water rinsing→nickel plating→water rinsing→tinplating→water rinsing→drying→reflowing→quenching→chromate treatment→water rinsing→drying.

In this process, it is possible that the anodically treated steel sheet is plated with tin-nickel alloy, nickel-iron alloy, nickel-zinc alloy, or nickel containing boron and phosphorus instead of plating with nickel. In the present invention, an anodic treatment of a pickled steel sheet in an alkaline electrolyte with a pH of above 10 is indispensable in order to obtain the thin tin and nickel plated steel sheet having a surface structure in which the distribution of numerous nodules of metallic tin is observed by using an electron microscope on the iron-tin-nickel alloy layer formed on the steel sheet after reflowing of the tin and nickel plated steel sheet. The alkaline electrolyte having a pH of above 10 used for the anodic treatment of the pickled steel sheet is made up by the dissolution of at least one alkaline compound selected from the group consisting of a hydroxide, a carbonate, a bicarbonate, a silicate, a phosphate, and a borate of an alkali metal and ammonium compounds in water. Furthermore, the effect of the anodic treatment of the pickled steel sheet in the alkaline electrolyte is not reduced as long as the pH of the alkaline electrolyte is maintained above 10, even if at least one compound such as an acidic phosphate, an oxalate, a citrate, and an acetate of an alkali metal, and an ammonium compound is added, the surface active agent which is usually added to the alkaline solution for degreasing of the steel sheet is added or a small amount of sulfuric acid or hydrochloric acid is brought into the alkaline electrolyte of the present invention because of insufficient rinsing after pickling.

It is an essential condition that the alkaline electrolyte used for the anodic treatment of the pickled steel sheet should be maintained above a pH of 10, although it is not necessary to strictly control the concentration of hydroxide, carbonate, etc., salts of a alkali metal and ammonium compounds. If the concentration of the alkaline electrolyte is restricted, it is preferably in the range of 10 to 100 g/l. At below 10 g/l, a waste of electric power results because of the higher electric resistance of the alkaline electrolyte. The concentration is limited to 100 g/l from the viewpoint of economy, although the effect of the anodic treatment in the alkaline electrolyte is not increased even if the concentration is above 100 g/l. Although it is not necessary that the temperature of the alkaline electrolyte be strictly controlled, it is preferably below 90° C. from the viewpoint of energy savings.

In order to obtain the effect of the anodic treatment in the alkaline electrolyte, it is necessary that the quantity of electricity for the anodic treatment be in the range of 3 to 50 coulombs/dm$^2$, more preferably 5 to 30 coulombs/dm$^2$. If the quantity of electricity is below 3 coulombs/dm$^2$, the effect of the anodic treatment is not obtained because thin and dense iron oxide film is not uniformly formed on the surface of the pickled steel sheet. The quantity of electricity is limited to 50 coulombs/dm$^2$ from the viewpoint of the high speed production of the tin and nickel plated steel sheet and from the viewpoint of energy savings, although the effect of the anodic treatment in the alkaline electrolyte is not reduced.

In the case of the alkaline electrolyte having a pH of below 10, a large quantity of electricity is necessary in order to obtain the effect of the anodic treatment in the present invention. Therefore, a large quantity of electricity for the anodic treatment is not desirable from the viewpoint of the high speed production of the tin and nickel plated steel sheet according to the present invention.

For the high speed production of tin and nickel plated steel sheet according to the present invention, it is reasonable that the electrolytic time be 0.1 to 5 seconds, and the range of current density be 1 to 50 A/dm$^2$ in the anodic treatment of the pickled steel sheet.

The amount of nickel plated on the steel sheet which is anodically treated beforehand in the alkaline electrolyte with a pH of above 10 is one of the important factors in the present invention. The amount of plated nickel should be controlled in the range of 5 to 20 mg/m$^2$. The reason why the amount of plated nickel should be controlled in the range of 5 to 20 mg/m$^2$ in the present invention is explained by FIG. 2 to FIG. 4.

FIG. 2 shows the effect of the amount of plated nickel on the distribution of nodules of metallic tin on the iron-tin-nickel alloy layer formed on the steel sheet after tinplating and then reflowing of the tin and nickel plated steel sheet.

FIG. 3 shows the effect of the amount of plated nickel on the electric contact resistance of the tin and nickel plated steel sheet after heating at 210° C. for 20 minutes.

FIG. 4 shows the effect of the amount of plated nickel on the filiform corrosion resistance after lacquering of the tin and nickel plated steel sheet.

In FIG. 2 to FIG. 4, Curve A shows examples wherein nickel plating, tinplating, and then reflowing were carried out after the anodic treatment of the pickled steel sheet in an alkaline electrolyte, and Curve B shows examples without the anodic treatment before nickel plating. Samples used for Examples A and B in FIG. 2 to FIG. 4 were produced by the following same conditions in each step except for the anodic treatment of samples for Example A. Furthermore, samples shown in FIG. 4 were cathodically treated in chromic acid electrolyte after reflowing.

Degreasing . . . Cathodic electrolysis in 70 g/l of NaOH under 5 A/dm 2 for 2 seconds at 70° C.

Pickling . . . Immersion into 100 g/l of $H_2SO_4$ for 2 seconds at 25° C.

Anodic treatment . . . Anodic treatment in 70 g/l of NaOH (pH 14) at 5 A/dm$^2$ for 2 seconds at 70° C. (Only samples for Example A)

Nickel plating . . . Plating with various amounts of nickel under 3 A/dm$^2$ at 40° C. by using Watts bath.

Tinplating . . . Plating with 700 mg/m$^2$ of tin under 10 A/dm$^2$ at 40° C. by using phenolsulfonic acid bath (Ferrostan bath).

Reflowing . . . Raising the temperature of the tin and nickel plated steel sheet up to 280° C. during 1.6 seconds by using resistance heating.

Quenching . . . Rapid immersion into water after reflowing

Chromate treatment . . . Cathodic treatment in chromic acid electrolyte containing 30 g/l of $CrO_3$ and 0.3 g/l of $H_2SO_4$ under 10 A/dm$^2$ for 0.5 seconds at 50° C.

Water rinsing was carried out between each step.

As shown in FIG. 2, in the case of Example A, numerous nodules of metallic tin were observed by an electron microscope on the iron-tin-nickel alloy layer formed on the steel sheet in the range of 5 to 20 mg/mn$^2$ of plated nickel, but nodular metallic tin is almost not present at above 20 mg/m$^2$ and at below 5 mg/m$^2$ of plated nickel.

On the other hand, in the case of Example B, nodular metallic tin is also almost not observed without the dependence on the amount of plated nickel.

Generally, the weldability is evaluated by an available range of secondary current in welding as shown in the report by N. T. Williams (Metal Construction, April 1977, pages 157–160), that is to say, the wider the secondary current range in welding, the better the weldability. The upper limit in the available secondary current range corresponds to the welding conditions in which some defect such as splashing is found and the lower limit corresponds to the welding conditions in which the breakage occurs in the welded part by the tearing test. However, in order to obtain data wherein the available range of secondary current in welding is decided for each sample, a large amount of samples are necessary. Therefore, the weldability is evaluated by electric contact resistance, because electric contact resistance has an apparent correlation with the available range of secondary current in welding as shown in the report by T. Fujimura (Journal of The Iron and Steel Institute of Japan, Vol. 69, No. 13, September 1983, page 181), that is, the lower the electric contact resistance, the wider the secondary current range in welding. Accordingly, if the electric contact resistance is lower, the weldability is better.

It is found from FIG. 3 that the electric contact resistance of samples for Example A is lower than that in the sample for Example B at below 20 mg/m$^2$ of plated nickel wherein nodular metallic tin is observed on the iron-tin-nickel alloy layer formed on the steel sheet in the sample for Example A. At below 5 mg/m$^2$ plated nickel, the electric contact resistance becomes slightly high because of the decrease in the amount of metallic tin by the formation of an alloy consisting mainly of iron-tin alloy. The electric contact resistance increases with an increase in the amount of plated nickel because of the decrease in the amount of metallic tin caused by the formation of an alloy consisting mainly of tin-nickel alloy during aging at ordinary temperature.

As shown in FIG. 4, the filiform corrosion resistance is improved with an increase in the amount of plated nickel. In the range of 5 to 30 mg/m$^2$ of plated nickel, the filiform corrosion resistance after lacquering of samples for Example A is excellent compared with that of Example B because the iron-tin-nickel alloy having excellent lacquer adhesion is present with numerous nodules of metallic tin on the surface of samples for Example A, but the surface of the samples for Example B is covered with uniform metallic tin layer having poor lacquer adhesion.

As described above, the anodic treatment of the pickled steel sheet in an alkaline electrolyte and the plating with the limited amount of nickel are indispensible factors in the present invention.

The reason why the anodic treatment of the pickled steel sheet in an alkaline electrolyte and the plating with the limited amount of nickel is necessary in order to produce the tin and nickel plate steel sheet having numerous nodules of metallic tin on the iron-tin-nickel alloy layer formed on the steel sheet is not clear. However, it is assumed that the reason is the formation of numerous nodules of metallic tin by dewetting of metallic tin electrodeposited in the part wherein iron oxide is formed on the pickled steel sheet by the anodic treatment in an alkaline electrolyte and the concentration of metallic tin to the part wherein nickel is electrodeposited during the formation of an iron-tin-nickel alloy layer by reflowing after tinplating. Furthermore, it is assumed that the reason why the tin and nickel plated steel sheet having numerous nodules of metallic tin on the iron-tin-nickel alloy layer formed on the steel sheet is excellent in weldability and corrosion resistance after lacquering, particularly filiform corrosion resistance, is that excellent weldability is maintained in the area having a large amount of metallic tin in nodular form compared with an average amount of plated metallic tin and that excellent corrosion resistance after lacquering is maintained in the area where iron-tin-nickel alloy having excellent lacquer adhesion is exposed on the surface without being covered by a uniform metallic tin layer.

Therefore, the amount of nickel above 20 mg/m$^2$ is not desirable in the present invention because thin iron oxide formed by the anodic treatment in the alkaline electrolyte is almost removed during nickel plating. In the present invention, a known nickel plating electrolyte such as a Watts bath containing 200 to 300 g/l of nickel sulfate, 20 to 50 g/l of nickel chloride, and 20 to 40 g/l of boric acid or a nickel sulfamate bath containing 300 to 500 g/l of nickel sulfamate, and 20 to 40 g/l of boric acid is used for nickel plating of the steel sheet treated anodically in an alkaline electrolyte. The plating 5 to 20 mg/m$^2$ which is required in the present invention is carried out by using these electrolytes described above under 2 to 30 A/dm$^2$, 30° to 70° C. of the electrolyte temperature, and 1 to 10 coulombs/dm$^2$ of a quantity of electricity.

In the present invention, the amount of tin plated on the nickel plated steel sheet is also one of the important factors. The amount of plated tin should be controlled in the range of 400 to 900 mg/m$^2$.

If the amount of plated tin is below 400 mg/m$^2$, numerous nodules of metallic tin are not formed on the iron-tin-nickel alloy layer formed on the steel sheet by reflowing because a large part of electrodeposited metallic tin changes to iron-tin-nickel alloy by reflowing. At above 900 mg/m$^2$ of plated tin, numerous nodules of metallic tin are not obtained by reflowing because the iron-tin-nickel alloy layer formed by reflowing is uniformly covered with a large amount of metallic tin.

Tinplating on the nickel plated steel sheet in the present invention is carried out by using a known tinplating electrolyte used for the production of electrotinplate. For instance, a phenolsulfonic acid bath (Ferrostan bath) containing 10 to 30 g/l of phenolsulfonic acid as sulfuric acid, 10 to 40 g/l of stannous sulfate or stannous phenolsulfonate and 0.5 to 10 g/l of ethoxylated α-naphthol sulfonic acid, halogenide bath containing stannous chloride, alkali halogenide, and additives or an alkaline bath containing alkali stannate and alkali hydroxide is used in the present invention.

The conditions for tinplating in the present invention are also almost the same as that for the production of conventional electrotinplate. For instance, tinplating by using a Ferrostan bath is carried out under 5 to 50 A/dm$^2$ of current density at 30° to 55° C. of electrolyte temperature.

Reflowing, that is flow melting of electrodeposited metallic tin after nickel and tin plating, is also indispensible in order to form numerous nodules of metallic tin on the iron-tin-nickel alloy layer which is an inventive feature in the present invention.

The known method in which a temperature above the melting point of tin is maintained for a short time by resistance heating and induction heating can be used for reflowing of the tin and nickel plated steel sheet in the present invention.

It is suitable in the present invention that the tin and nickel plated steel sheet is heated from 235° to 350° C. for 0.5 to 3 seconds and then it is immediately quenched into water.

Reflowing at a higher temperature for a longer time is not desirable because of the poor weldability caused by the change of a large part of plated metallic tin to iron-tin-nickel alloy, particularly in the case of a lower amount of plated metallic tin. Furthermore, reflowing at lower temperature for a short time is not also desirable because of the poor corrosion resistance after lacquering caused by insufficient formation of the iron-tin-nickel alloy layer, particularly in the case of a higher amount of plated metallic tin.

After reflowing, the tin and nickel plated steel sheet according to the present invention is cathodically treated in a known electrolyte such as a sodium dichromate solution which is used for conventional post-treatment of an electrotinplated, or a chromic acid solution containing a small amount of sulfuric acid, fluoric acid, fluoboric acid, fluosilicic acid, an alkali salt thereof, and a combination thereof which is used for the production of conventional tin free steel having an upper layer of hydrated chromium oxide and a lower layer of metallic dhromium, in order to ensure excellent characteristics in lacquer adhesion, corrosion resistance before or after lacquering. For instance, the tin and nickel plated steel sheet according to the present invention is cathodically treated in 20 to 100 g/l of a dichromate of an alkali metal or ammonium or chromic acid solution containing 0.01 to 5% of sulfuric acid, fluoric acid, fluoboric acid, fluosilicic acid, an alkali metal salt thereof, or a combination thereof based on the amount of chromic acid under 5 to 40 A/dm$^2$ of a current density for 0.1 to 5 seconds of a treating time at 30° to 70° C. of electrolyte temperature.

The amount of total chromium in the film formed on the tin and nickel plated steel sheet by cathodic treatment in dichromate or chromic acid solution described above should be limited to 3 to 20 mg/m$^2$, preferably 5 to 15 mg/$^2$. If the amount of total chromium is below 3 mg/m$^2$, the excellent corrosion resistance before or after lacquering is not obtained, although the weldability does not change.

At above 20 mg/m$^2$ of total chromium in the film formed by cathodic treatment in dichromate or chromic acid solution, the current range for sound welding becomes narrow because of the formation of thicker chromium oxide having high electric resistance by the dehydration of the formed hydrated chromium oxide or the oxidation of metallic chromium during heating for lacquer curing.

In the present invention, the presence of hydrated chromium oxide is indispensable in order to obtain the excellent corrosion resistance before or after lacquering. Moreover, the presence of metallic chromium is desirable for the improvement of filiform corrosion resistance after lacquering. Therefore, in the case where the film formed by chromate treatment consists of an upper layer of hydrated chromium oxide and a lower layer of metallic chromium, the amount of metallic chromium should be limited to 2 to 17 mg/m$^2$ and the amount of hydrated chromium oxide should be limited to 3 to 18 mg/m$^2$ as chromium.

BRIEF DESCRIPTION OF THE DRAWING

In FIG. 2 to FIG. 4, Curve A shows examples wherein nickel plating, tinplating, and then reflowing were carried out after the anodic treatment of the pickled steel sheet in an alkaline electrolyte according to the present invention and Curve B shows examples without anodic treatment before nickel plating. Furthermore, samples shown in FIG. 4 were cathodically treated in chromic acid electrolyte containing a small amount of sulfuric acid after reflowing.

EXAMPLES OF THE PRESENT INVENTION

Figure 1:
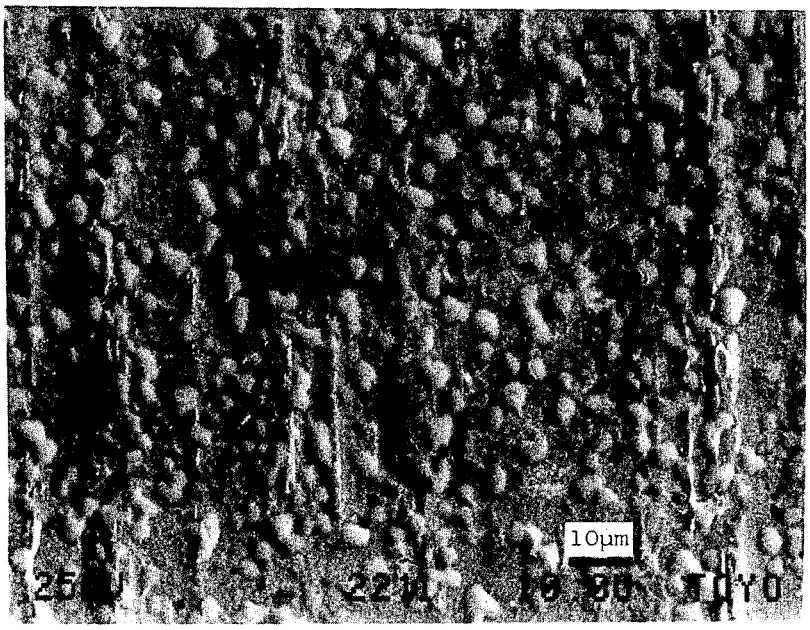
FIG. 1 shows the magnified photograph wherein numerous nodules of metallic tin 1 are distributed on the uniform iron-tin-nickel alloy layer 2 in the surface of the tin and nickel plated steel sheet according to the present invention.
Figure 2:
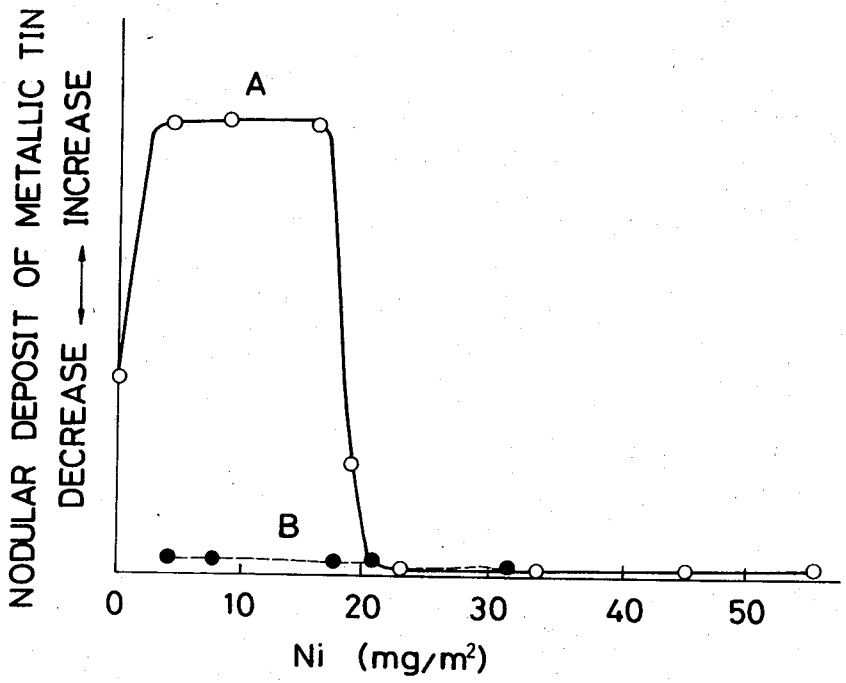
FIG. 2 shows the effect of the amount of plated nickel on the distribution of nodular metallic tin on the iron-tin-nickel alloy layer formed on the steel sheet after tinplating and then reflowing.
Figure 3:
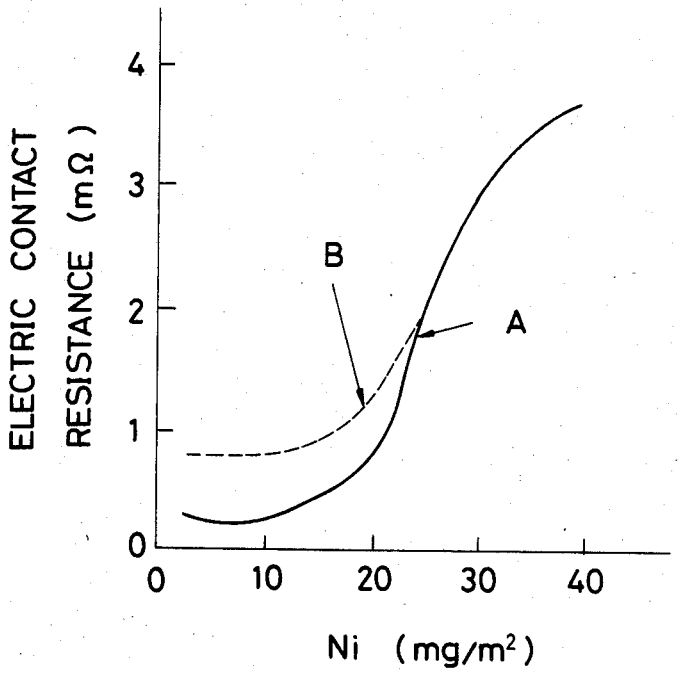
FIG. 3 shows the effect of the amount of plated nickel on the electric contact resistance of the tin and nickel plated steel sheet after heating at 210° C. for 20 minutes.
Figure 4:
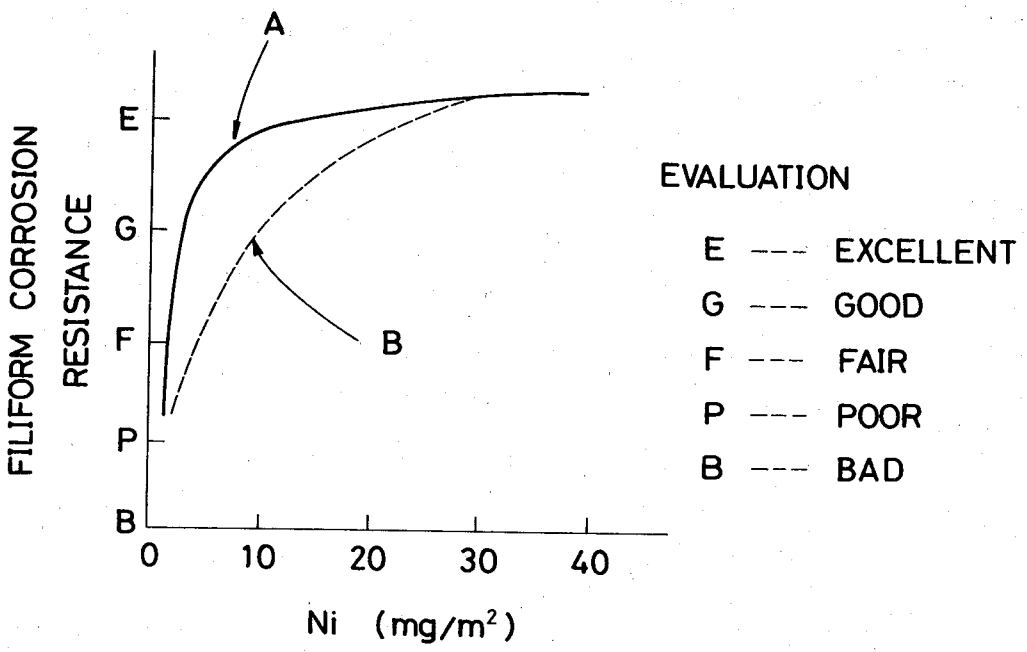
FIG. 4 shows the effect of the amount of plated nickel on the filiform corrosion resistance after lacquering of the tin and nickel plated steel sheet.

The present invention is illustrated by the following examples.

In Example 1 to Example 4 and Comparative Example 1 to Comparative Example 4, a cold rolled steel sheet having a thickness of 0.2 mm was basically treated by the following process after electrolytically degreasing in a solution of 70 g/l of sodium hydroxide, water rinsing, pickling by an immersion into 100 g/l of sulfuric acid, and then water rinsing.

Anodic treatment in an alkaline electrolyte→water rinsing nickel plating→water rinsing→tinplating→water rinsing drying→reflowing→quenching→chromate treatment→water rinsing→drying.

In Comparative Example 1, anodic treatment in an alkaline electrolyte was omitted in the present scheme as described above. In Comparative Example 2, reflowing after tinplating was omitted. In Comparative Example 3, the anodically treated steel sheet was plated with nickel above the upper limited amount in the present invention. In Comparative Example 4, the nickel plated steel sheet was plated with tin below the lower limited amount in the present invention.

In Example 1 to Example 4 and Comparative Example 1 to Comparative Example 4, a Watts bath containing 250 g/l or $NiSO_4 \cdot 6H_2O$, 30 g/l of $NiCl_2 \cdot 6H_2O$, and 40 g/l of $H_3BO_3$ or sulfamic acid bath containing 350 g/l of nickel sulfamate and 40 g/l of $H_3BO_3$ was used for nickel plating. Furthermore, a Ferrostan bath containing 60 g/l of $SnSO_4$, 30 g/l of phenolsulfonic acid and 5 g/l of ethoxylated α-naphthol sulfonic acid or alkaline bath containint 80 g/l of $Na_2SnO_3$ and 15 g/l of NaOH was used for tinplating after nickel plating.

The tin and nickel plated steel sheet was immediately quenched in water after reflowing, and the temperature of the tin and nickel plated steel sheet dropped to 280° C. over 1.6 seconds except in Comparative Example 2. the other conditions in every Example are shown in the attached table.

The weldability, and corrosion resistance after lacquering of the tin and nickel plated steel sheet in the above described Examples and Comparative Examples were evaluated by the following testing methods after the measurement of the amounts nickel, tin, metallic chromium, and chromium in a hydrated chromium oxide by the fluorescent X-ray method, and the results were shown in the attached Table.

(1) WELDABILITY

The weldability was evaluated by electric contact resistance for the reason already described.

At first, the sample plated on both sides was cut to a size of 20 mm × 100 mm after heating at 210° C. for 20 minutes. The electric contact resistance was calculated from the change of voltage in a pair of copper disk electrodes (diameter: 65 mm, thickness: 2 mm) to which 5 amperes of direct current were supplied and 50 kg of load was added, when two sample pieces were inserted between a pair of the copper disk electrodes rotating at 5 m/min.

(2) FILIFORM CORROSION RESISTANCE AFTER LACQUERING (TEST 1)

The sample was baked at 200° C. for 10 minutes after coating with 75 mg/dm² of a vinyl organosol. The coated sample was immersed into 3% sodium chloride solution for 1 hour and then was left in a chamber having 85% of relative humidity of 45° C. for 10 days after the surface of the coated sample was cross-hatched by a razor and then expanded for 5 mm by an Erichsen tester.

The result of filiform rusting spread from the scratched part of the coated sample was divided into 5 ranks, namely, excellent, good, fair, poor, and bad.

(3) UNDERCUTTING CORROSION RESISTANCE AFTER LACQUERING (TEST 2)

The sample was baked at 210° C. for 10 minutes after coating with 65 mg/m² of an epoxy-phenolic type of lacquer. The coated sample was immersed into the deaerated solution containing 1.5% of citric acid and 1.5% of sodium chloride for 15 days at 37° C. after the surface of the coated sample was cross-hatched by a razor.

The result of corrosion in the scratched part of the coated sample was divided into 5 ranks, namely, excellent, good, fair, poor, and bad.

TABLE

| | | | Example 1 | Example 2 | Example 3 | Example 4 |
|---|---|---|---|---|---|---|
| Conditions in each process | Anodic treatment in an alkaline electrolyte | | NaOH 70 g/l 30° C. 5 A/dm², 1 sec. | KOH 20 g/l 40° C. 10 A/dm², 3 sec. | $Na_2CO_3$ 10 g/l 30° C. 5 A/dm², 2 sec. | $Na_4P_2O_7$ $10H_2O$ 10 g/l 40° C. 10 A/dm², 3 sec. |
| | pH | | 14 | 13.5 | 11.5 | 10.5 |
| | Ni plating | | Watts bath 40° C., 5 A/dm² | Watts bath 40° C. 5 A/dm² | Sulfamic acid bath 40° C., 10 A/dm² | Sulfamic acid bath 30° C., 3 A/dm² |
| | Sn plating | | Phenolsulfonic acid bath 35° C. 10 A/dm² | Phenolsulfonic acid bath 40° C. 10 A/dm² | Alkali bath 80° C., 3A/dm² | Alkali bath 80° C., 2A/dm² |
| | Reflowing | | Reflow | Reflow | Reflow | Reflow |
| | Chromate treatment (Cathodic electrolysis) | | $CrO_3$ 30 g/l $H_2SO_4$ 0.3 g/l 40° C., 10 A/dm² | $CrO_3$ 40 g/l NaF 0.5 g/l 40° C. 15 A/dm² | $Na_2Cr_2O_7$ 30 g/l 40° C. 10 A/dm² | $CrO_3$ 30 g/l $Na_2SiF_6$0.5 g/l 30° C. 15 A/dm² |
| Distribution of metallic Sn on the surface | | | Nodular | Nodular | Nodular | Nodular |
| Coating weight (mg/m²) | Ni | | 18 | 5 | 10 | 15 |
| | Sn | | 420 | 870 | 750 | 750 |
| | Metallic Cr | | 7 | 15 | 0 | 10 |
| | Cr in hydrated Cr oxide | | 7 | 3 | 5 | 6 |
| Characteristics | Electric contact resistance (mΩ) | | 0.4 | 0.2 | 0.2 | 0.3 |
| | Corrosion resistance after lacquering | Test 1 | Excellent | Excellent | Excellent | Excellent |
| | | Test 2 | Excellent | Excellent | Excellent | Excellent |

| | | Comparative example 1 | Comparative example 2 | Comparative example 3 | Comparative example 4 |
|---|---|---|---|---|---|
| Conditions in each process | Anodic treatment in an alkaline electrolyte | No treatment | NaOH 70 g/l 30° C. 5 A/dm², 1 sec. | NaOH 70 g/l 30° C. 5 A/dm², 1 sec. | KOH 20 g/l 40° C. 10 A/dm², 3 sec. |
| | pH | — | 14 | 14 | 13.5 |

TABLE-continued

| | | | | | |
|---|---|---|---|---|---|
| | Ni plating | Watts bath 40° C., 5 A/dm$^2$ | Watts bath 40° C. 5 A/dm$^2$ | Watts bath 35° C., 10 A/dm$^2$ | Watts bath 40° C. 5 A/dm$^2$ |
| | Sn plating | Phenolsulfonic acid bath 35° C. 10 A/dm$^2$ | Phenolsulfonic acid bath 35° C. 10 A/dm$^2$ | Phenolsulfonic acid bath 35° C. 10 A/dm$^2$ | Phenolsulfonic acid bath 35° C. 10 A/dm$^2$ |
| | Reflowing | Reflow | Unreflow | Reflow | Reflow |
| | Chromate treatment (Cathodic electrolysis) | $CrO_3$ 30 g/l $H_2SO_4$ 0.3 g/l 40° C. 10 A/dm$^2$ | $CrO_3$ 60 g/l $H_2SO_4$ 0.4 g/l 40° C. 12 A/dm$^2$ | $CrO_3$ 30 g/l $H_2SO_4$ 0.3 g/l 40° C. 10 A/dm$^2$ | $CrO_3$ 30 g/l NaF 0.5 g/l 40° C. 15 A/dm$^2$ |
| Distribution of metallic Sn on the surface | | Uniform | Uniform | Uniform | Uniform |
| Coating weight (mg/m$^2$) | Ni | 10 | 15 | 70 | 17 |
| | Sn | 450 | 700 | 500 | 220 |
| | Metallic Cr | 6 | 5 | 5 | 15 |
| | Cr in hydrated Cr oxide | 5 | 6 | 7 | 3 |
| Characteristics | Electric contact resistance (mΩ) | 1.1 | 0.3 | 5.2 | 8.3 |
| | Corrosion resistance after lacquering Test 1 | Fair | Poor | Excellent | Fair |
| | Corrosion resistance after lacquering Test 2 | Good | Good | Excellent | Fair |

We claim:

1. A method for producing a tin and nickel plated steel sheet having a surface structure in which the distribution of numerous nodules of metallic tin are observed by using an electron microscope (1000 magnifications) on an iron-tin-nickel alloy layer formed on a steel sheet with comprises:

(1) anodically treating a substantially clean steel sheet in an alkaline electrolyte with a pH of above 10, (2) nickel electroplating the steel sheet treated by step (1), (3) electrotinplating the steel sheet plated with nickel by step (2), (4) reflowing and quenching the tin and nickel plated steel sheet by step (3), and (5) chromate treatment of the tin and nickel plated steel sheet obtained by step (4)

2. The method according to claim 1, wherein the amount of plated nickel is from 5 to 20 mg/m$^2$, the amount of plated tin is from 400 to 900 mg/m$^2$, and the amount of hydrated chromium oxide is from 3 to 20 mg/m$^2$ as chromium.

3. The method according to claim 1, wherein the amount of plated nickel is from 5 to 20 mg/m$^2$, the amount of plated tin is from 400 to 900 mg/m$^2$, and the amount of total chromium, hydrated chromium oxide as chromium and metallic chromium is from 3 to 20 mg/m$^2$, from 3 to 18 mg/m$^2$ and from 2 to 17 mg/m$^2$, respectively, in the film consisting of an upper layer of hydrated chromium oxide and a lower layer of metallic chromium.

4. The method according to claim 1, wherein said anodic treatment of a substantially clean steel sheet in an alkaline electrolyte is carried out under a quantity of electricity of 3 to 50 coulombs/dm$^2$, a current density of 1 to 50 A/dm$^2$ and a treating time of 0.1 to 5 seconds at a temperature of 20° to 90° C. in an alkaline electrolyte with a pH of above 10 containing 10 to 100 g/l of at least one alkaline compound selected from the group consisting of a hydroxide, a carbonate, a bicarbonate, a silicate, a phosphate, a pyrophosphate, and a borate of an alkali metal and ammonium compound.

5. The method according to claim 1, wherein said nickel plating is carried out under a quantity of electricity of 1 to 10 coulombs/dm$^2$, a current density of 2 to 30 A/dm$^2$ at a temperature of 30° to 70° C. in a nickel plating electrolyte containing 200 to 300 g/l of nickel sulfate, 20 to 50 g/l of nickel chloride, and 20 to 40 g/l of boric acid or containing 300 to 500 g/l of nickel sulfamate, and 20 to 40 g/l of boric acid.

6. The method according to claim 1, wherein said tinplating is carried out under a current density of 5 to 50 A/dm$^2$ at a temperature of 30° to 55° C. in a tinplating electrolyte containing 10 to 40 g/l of stannous sulfate or stannous phenolsulfonate, 10 to 30 g/l of phenolsulfonic acid as sulfuric acid, and 0.5 to 10 g/l of ethoxylated α-naphthol sulfonic acid or ethoxylated α-naphthol.

7. The method according to claim 1, wherein said reflowing and quenching of the tin and nickel plated steel sheet is carried out by an immediate immersion into water, heating said tin and nickel plated steel sheet to 235° to 350° C. during 0.5 to 3 seconds.

8. The method according to claim 1, wherein said chromate treatment of said tin and nickel plated steel sheet is carried out under a cathodic current density of 5 to 40 A/dm$^2$ and a treating time of 0.1 to 5 seconds at a temperature of 30° to 70° C. in a solution containing 20 to 100 g/l of a dichromate of an alkali metal or ammonium compound containing 20 to 100 g/l of chromic acid having 0.01 to 5% of sulfuric acid, fluoboric acid, fluosilicic acid, an alkali salt thereof, and a combination thereof based on the amount of chromic acid.

9. The tin and nickel plated steel sheet according to claim (1).

10. The tin and nickel plated steel sheet according to claim (2).

11. The tin and nickel plated steel sheet according to claim (3).

12. The tin and nickel plated steel sheet according to claim (4).

13. The tin and nickel plated steel sheet according to claim (5).

14. The tin and nickel plated steel sheet according to claim (6).

15. The tin and nickel plated steel sheet according to claim (7).

16. The tin and nickel plated steel sheet according to claim (8).

* * * * *